US011592175B2

(12) United States Patent
Eriksson et al.

(10) Patent No.: US 11,592,175 B2
(45) Date of Patent: Feb. 28, 2023

(54) SMELT SPOUT CLEANING ASSEMBLY

(71) Applicant: THE BABCOCK & WILCOX COMPANY, Akron, OH (US)

(72) Inventors: Mikael Eriksson, Skutskär (SE); Simon F Youssef, Lancaster, OH (US); Joseph Clay, Reynoldsburg, OH (US)

(73) Assignee: The Babcock & Wilcox Company, Akron, OH (US)

( * ) Notice: Subject to any disclaimer, the term of this patent is extended or adjusted under 35 U.S.C. 154(b) by 0 days.

(21) Appl. No.: 17/332,894

(22) Filed: May 27, 2021

(65) Prior Publication Data

US 2021/0372614 A1 Dec. 2, 2021

Related U.S. Application Data

(60) Provisional application No. 63/031,172, filed on May 28, 2020.

(51) Int. Cl.

| | |
|---|---|
| ***F23J 3/02*** | (2006.01) |
| ***D21C 11/10*** | (2006.01) |
| ***B08B 9/043*** | (2006.01) |

(52) U.S. Cl.

CPC ..... *F23J 3/02* (2013.01); *B08B 9/0436* (2013.01); *D21C 11/106* (2013.01); *B08B 2209/04* (2013.01)

(58) Field of Classification Search

CPC .. B08B 9/0436; B08B 2209/04; D21C 11/106

See application file for complete search history.

(56) References Cited

U.S. PATENT DOCUMENTS

| | | | | |
|---|---|---|---|---|
| 5,542,650 | A * | 8/1996 | Abel | F27D 25/001 266/271 |
| 2008/0087302 | A1* | 4/2008 | Koskela | F23J 1/08 134/167 R |
| 2008/0282486 | A1* | 11/2008 | Pingel | F23J 1/02 15/104.063 |

FOREIGN PATENT DOCUMENTS

GB 191105234 A * 9/1911

* cited by examiner

*Primary Examiner* — Natasha N Campbell

(74) *Attorney, Agent, or Firm* — Michael J. Seymour

(57) ABSTRACT

An assembly for cleaning a smelt spout includes a cleaning head, a drive rod connected with the cleaning head, and a pneumatic or other drive connected to selectively extend or retract the drive rod. The drive rod may be connected with the cleaning head by a pivotal connection. The cleaning head may be bifurcated. The cleaning head may include a leading edge configured to engage and clean a spout opening from which smelt from a chemical reduction furnace flows to the spout. The assembly may further include a pivot point and, as the drive selectively extends the drive rod, torque about the pivot point produced by the cleaning head and an extending portion of the drive rod rotates the cleaning head downward to engage a smelt spout.

21 Claims, 7 Drawing Sheets

SMELT SPOUT CLEANING ASSEMBLY

This application claims the benefit of U.S. Provisional Application No. 63/031,172 filed May 28, 2020 and titled "SMELT SPOUT CLEANING ASSEMBLY AND PROCESS". U.S. Provisional Application No. 63/031,172 filed May 28, 2020 and titled "SMELT SPOUT CLEANING ASSEMBLY AND PROCESS" is incorporated herein by reference in its entirety.

FIELD OF THE INVENTION

This invention relates to recovery boilers, to Kraft wood pulping processes, and to related fields.

BACKGROUND OF THE INVENTION

Conversion of wood into wood pulp is typically done using the Kraft process. Wood chips are cooked in a mixture containing water, sodium hydroxide, and sodium sulfide. This mixture, commonly referred to as white liquor, assists with separating the cellulose fibers (wood pulp) from the lignin holding the fibers together. The separated cellulose fiber are then removed, leaving behind a waste product, typically referred to as black liquor.

Reclamation and reuse of the cooking chemicals from the black liquor is desirable to control costs associated with the paper-making process. During the recovery process, the black liquor is concentrated into a solution containing approximately 65 to 80 percent solids. The concentrated solution is sprayed into the internal volume of a chemical reduction furnace, also sometimes referred to as a recovery boiler. In the chemical reduction furnace, organic materials in the black liquor are combusted by various processes such as evaporation, gasification, pyrolysis, oxidation, and reduction, which reduce the black liquor into a molten smelt of spent cooking chemicals. The molten smelt exits the chemical reduction furnace through a boiler outlet port and flows along a smelt spout to a collection tank.

Boiler outlet ports and smelt spouts are designed to drain the molten smelt from the internal volume of the furnace at a desired rate that maintains a safe smelt level within the furnace and furnace efficiency. Typically, the molten smelt exits the boiler at a temperature of approximately 1000 degrees Celsius and, upon contact with ambient air, extremities of the smelt flow may cool enough to become hardened. Such hardening can result in deposits and/or a hardened crust on top of the molten smelt in the outlet opening and/or smelt spout. Hardened smelt is undesirable. It may obstruct the flow of the molten smelt, thereby reducing the effectiveness of the outlet port and smelt spout, and result in an undesirably high smelt level within the furnace. Further, a reduced smelt flow may cause the molten smelt to remain in the smelt spout longer, thereby increasing the time that the smelt is subject to ambient temperatures and increasing the likelihood that additional hardened deposits form.

High smelt levels within the furnace are undesirable, as they can lead to or otherwise cause operational concerns and/or difficulties. For example, a high smelt level may cause inefficient and unpredictable furnace operations, such as a decrease in the amount of chemicals that can be recovered, a decrease in the process steam outputted from the boiler tubes of the furnace, and increased emission of noxious gases such as carbon monoxide and sulfur dioxide. Further, hardened blockages and/or inhibited flow may cause the molten smelt to splash out of the spout, causing undesirable operating conditions and/or localized damage.

In extreme blockage conditions, smelt could build up to dangerous levels within the furnace resulting in corrosion, fires, decreased operability, boiler failure, and/or smelt spills.

Hardened deposits are generally dislodged manually from the outlet port and the spout at regular intervals. Typically, in a process referred to as "rodding", workers hold a long rod with a tool attached to the distal end that scrapes hardened deposits from the spout and/or outlet port. Manual rodding is a physically demanding task susceptible to inefficient or improper cleanings. Smelt spouts are typically cooled by water circulating in a water jacket surrounding the spout. Improper rodding carries a risk of rupturing the water jacket, which may result in an explosive or otherwise undesirable condition.

Certain improvements are disclosed herein.

BRIEF SUMMARY

In some illustrative embodiments disclosed herein as nonlimiting examples, an assembly for cleaning a smelt spout is disclosed. The assembly includes a cleaning head, a drive rod connected with the cleaning head, and a drive connected to selectively extend or retract the drive rod. In some embodiments, the drive comprises a pneumatic drive. In some embodiments, the drive rod is connected with the cleaning head by a pivotal connection. In some embodiments, the cleaning head has a length and the length has a curved profile. In some embodiments, the cleaning head is bifurcated. In some embodiments, the cleaning head includes a leading edge configured to engage and clean a spout opening from which smelt from a chemical reduction furnace flows to the spout. In some embodiments, the assembly further includes a pivot point and, as the drive selectively extends the drive rod, torque about the pivot point produced by the cleaning head and an extending portion of the drive rod rotates the cleaning head downward to engage a smelt spout.

In some illustrative embodiments disclosed herein as nonlimiting examples, a smelt spout assembly includes a smelt spout and an assembly as set forth in the immediately preceding paragraph arranged to clean the smelt spout. In some embodiments, the arrangement is by a connection with the smelt spout or with a housing of the smelt spout to clean the smelt spout. In some embodiments, the assembly is mounted on an articulated arm by which the assembly can be swung out and away from the smelt spout.

In some illustrative embodiments disclosed herein as nonlimiting examples, a method of cleaning a smelt spout is disclosed. In the method, a drive rod is extended, on which a cleaning head is pivotally attached. In response to the extending, the cleaning head is pivoted about a second pivot point to lower the cleaning head onto the smelt spout and then the cleaning head is driven along the spout to clean the spout. The method may optionally further include, in further response to the extending, driving the cleaning head at least partway into a spout opening to clean the spout opening. In some embodiments, the method further includes retracting the drive arm. In response to the retracting, the cleaning head is drawn back along the spout and then the cleaning head is pivoted about the second pivot point to raise the cleaning head away from the smelt spout and into a resting position.

In some illustrative embodiments disclosed herein as nonlimiting examples, an assembly for cleaning a smelt spout is disclosed. The assembly includes: a drive rod; a cleaning head pivotally attached to the cleaning head; a drive connected to selectively extend or retract the drive rod;

and a second pivot about which the cleaning head rotates to selectively lower the cleaning head in response to drive extending the drive rod and to selectively raise the cleaning head in response to the drive retracting the drive rod. In some embodiments, the drive comprises a pneumatic drive. In some embodiments, the cleaning head is bifurcated. In some embodiments, the cleaning head includes a leading edge configured to extend at least partway into a spout opening. In some embodiments, the assembly further includes an extended locking mechanism including: stabilizing rod arranged parallel with the drive rod and attached to the drive rod by a link whereby the stabilizing rod extends or retracts together with the drive rod; and a collar through which the stabilizing rod passes, the collar secured to the drive.

In some illustrative embodiments disclosed herein as nonlimiting examples, a smelt spout assembly includes a smelt spout and an assembly as set forth in the immediately preceding paragraph arranged to clean the smelt spout.

DETAILED DESCRIPTION OF THE INVENTION

Figure 1:
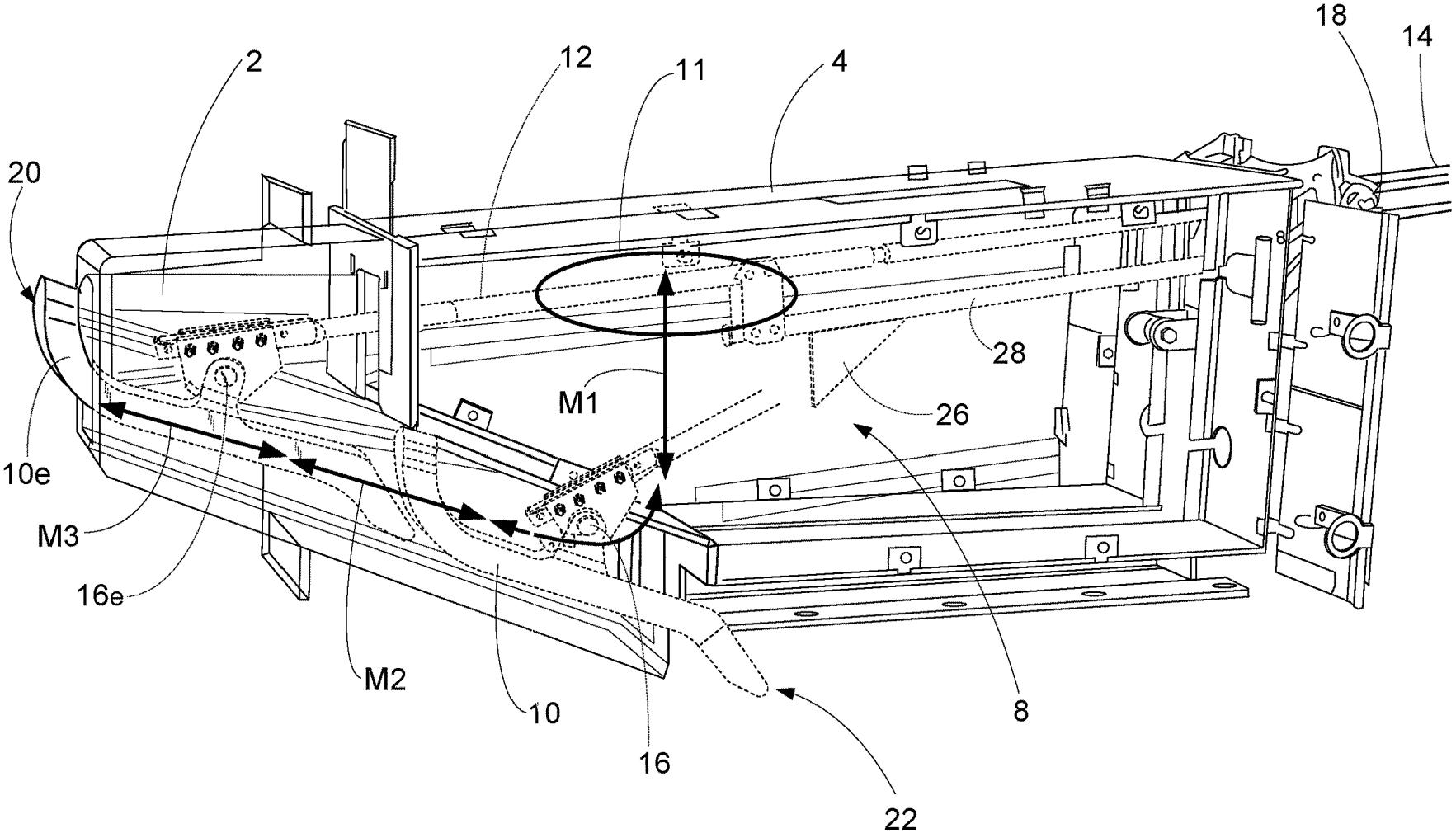
FIG. 1 diagrammatically illustrates a perspective view of a smelt spout shown in phantom, along with a spout cleaning assembly for cleaning a smelt spout.

With reference to FIG. 1, a smelt spout 2 is shown in phantom, along with a spout cleaning assembly 8 for cleaning a smelt spout 2. An optional spout hood or housing 4 is also shown in phantom. The smelt spout 2 may, for example, comprise the smelt spout 2 of a chemical reduction furnace, such as may be used in a Kraft process, as an example. The spout cleaning assembly 8 includes a cutting head 10 shown in FIG. 1 running up the spout 2. The cutting head 10 is also shown in FIG. 1 at its end position (head depiction 10*e*). The cutting head's resting position 11 is also indicated in FIG. 1. The spout cleaning assembly 8 is affixed to the spout hood or housing 4 utilizing bolts and/or other connectors or the like.

Figure 2:
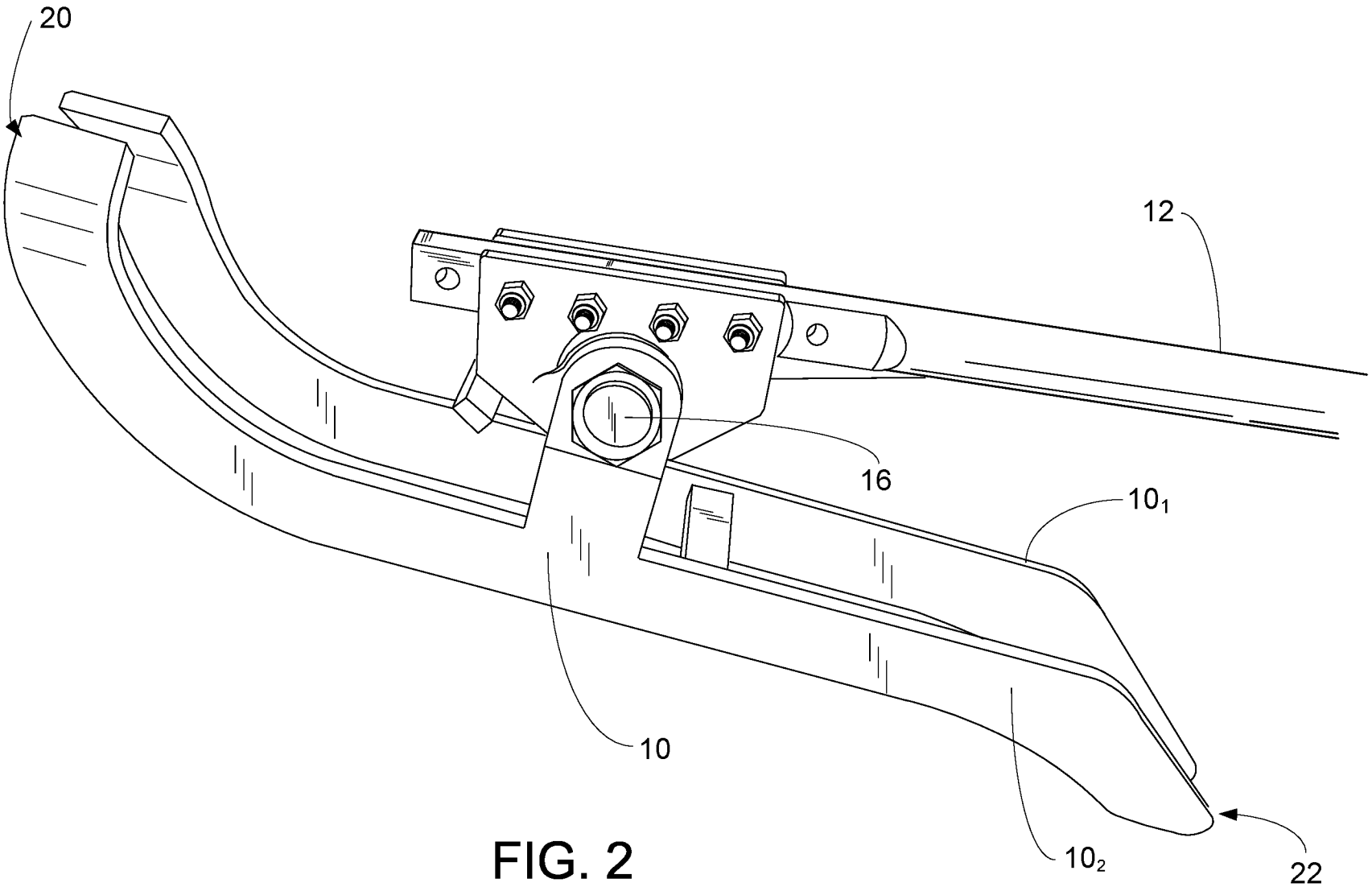
FIG. 2 diagrammatically illustrates an isolation perspective view of the cleaning/cutting head and a portion of a connecting drive rod of the spout cleaning assembly of FIG. 1.

With continuing reference to FIG. 1 and with further reference to FIG. 2 which shows an isolation view of the cleaning/cutting head 10 and a portion of a connecting drive rod 12, the cleaning/cutting head 10 is attached to the drive rod 12. In a first cleaning position the drive rod 12 is retracted. In a second cleaning position the drive rod 12 is extended. In the first cleaning position the cleaning head is at a first elevation. In the second cleaning position the cleaning head is at a second elevation. In the fully extended position (corresponding to cleaning head depiction 10*e* in FIG. 1) the cleaning head 10*e* may extend beyond the distal end of the spout 2. The drive rod 12 may also be in resting position in which the cutting head is elevated and rests above the spout (e.g., at the cutting head's resting position 11 indicated in FIG. 1).

Movements between the first and second cleaning position is controlled by a drive such as a pneumatic drive 14 (or, in other contemplated embodiments, a hydraulic drive, an electric motor-driven drive, or so forth). Force exerted by the drive 14 causes the cleaning head 10 to engage the spout 2. As addition force is applied by the drive 14 to extend the drive rod 12 further outward, the cleaning head 10 traverses the length of the spout 2 until the second cleaning position is reached. In some systems the connection between the cleaning head 10 and drive rod 12 is a pivotal connection 16 (also labeled FIG. 1 as pivot connection 16*e* for the depiction 10*e* of full head extension). The pivot connection 16 enables the cleaning head 10 to rotate about the pivot 16 and match the profile of the spout 2 as the cleaning head 10 traverses a length of the spout 2. In some systems, one or more springs (not shown) are attached to the pivot point 16 to obtain a desired rotational resistance. In some embodiments, rotational resistance improves the ability of the cleaning head 10 to remove cooled smelt.

Movement between the resting position (that is, position 11 indicated in FIG. 1) to other positions may be assisted with gravity. In one embodiment the drive rod 12 and the cleaning head 10 function as a swing arm with a pivot point 18, such that the cleaning head 10 descends from the resting position to the first cleaning position. The pivotal point 18 of the swing arm may also include on or more springs or rotational inhibitors (not shown) to obtain a desired rotational resistance.

Figure 3:
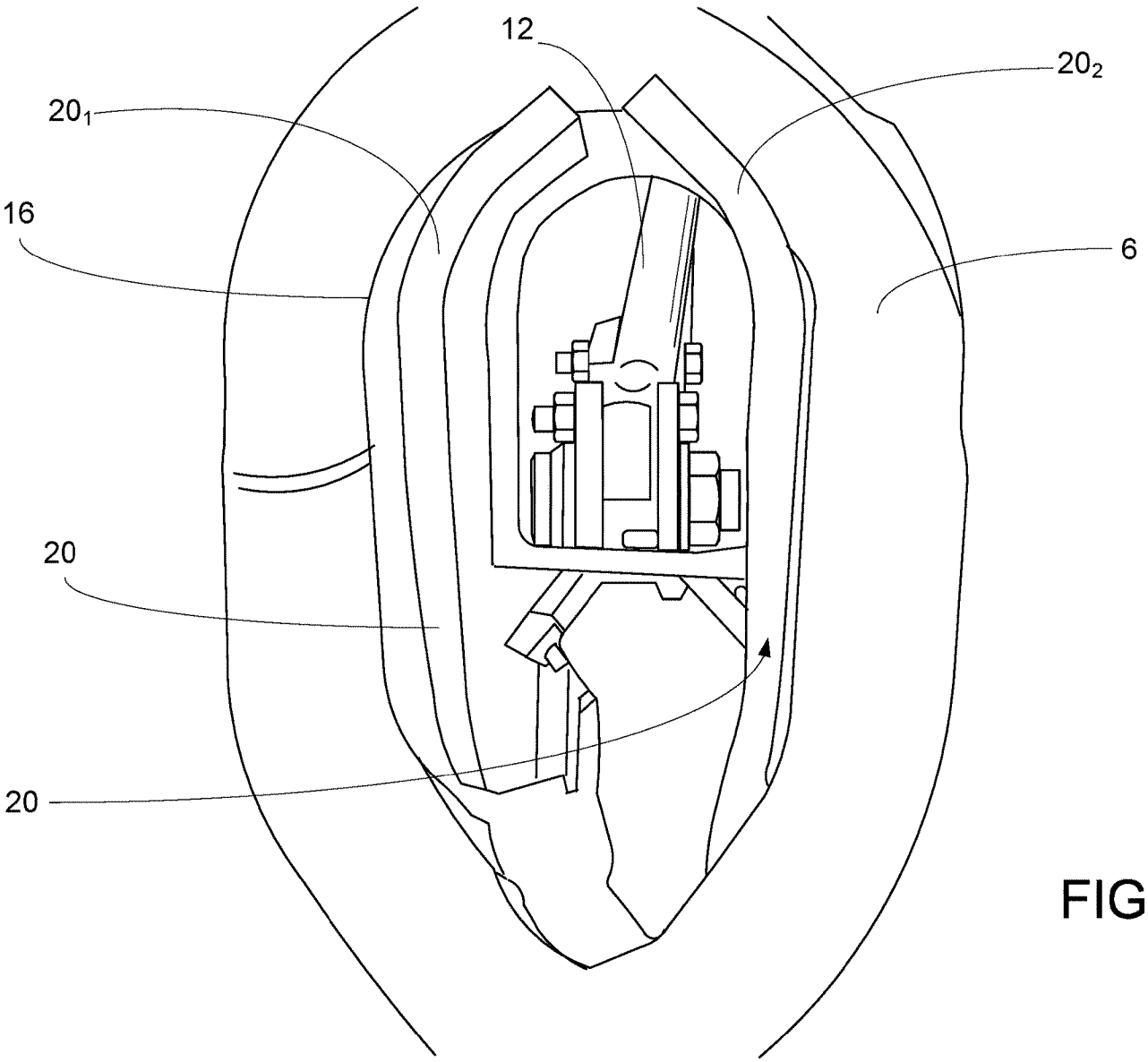
FIG. 3 diagrammatically illustrates a bifurcated leading edge of the bifurcated cleaning head of FIGS. 1 and 2 inserted into a spout intake.

With continuing reference to FIGS. 1 and 2 and with further reference to FIG. 3, variations in furnace outlets, spout intakes and spouts typically may be accommodated by a cleaning head whose detailed shape is designed for each smelting spout 2. Preferably the cleaning head 10 conforms with the geometry of the spout 2. In the illustrative cleaning head 10, the leading edge 20 of cleaning head 10 is bifurcated. FIG. 2 illustrates a fully bifurcated cleaning head 10, having a head portion $\mathbf{10}_1$ and a head portion $\mathbf{10}_2$. (labeled only in FIG. 2). FIG. 3 illustrates the bifurcated leading edge 20 of the bifurcated cleaning head 10 inserted into a spout intake 6. More particularly, in FIG. 3 the leading edge portion $\mathbf{20}_1$ and the leading edge portion $\mathbf{20}_2$ of the respective cleaning head portions $\mathbf{10}_1$ and $\mathbf{10}_2$ are labeled in FIG. 3 (only). The cleaning head 10 (and more particularly the leading edge 20 thereof) is designed to be slightly smaller than the spout opening 6. In this manner, cleaning (including cleaning of the spout opening 6) can occur without requiring the bifurcated head 10 to engage the spout intake 6 and flex inward. This design further minimizes risk of cleaning head 10 getting stuck in spout opening 6. The leading edges $\mathbf{20}_1$, $\mathbf{20}_2$ of the cleaning head 10 are suitably profiled to include blades and/or fillets to assist with cleaning and moving the removed hardened smelt in a desired direction. Notably, extension of the drive rod 12 to the fully extended position (e.g., shown in FIG. 1 as fully extended position 10*e*) operates to push the leading edges $\mathbf{20}_1$, $\mathbf{20}_2$ of the cleaning head 10 partway into the spout opening 6 as seen in FIG. 3 to effectively clean the spout opening 6 as part of the spout cleaning process.

With particular reference to FIG. 2, the cleaning head 10 may also include a curved profile along its length. In such embodiments, the trailing edge 22 of the profile engages with the spout channel. This engagement promotes a desired rotation of the cleaning head about the pivot point 16, such that the leading edge 20 enters the spout intake 6 (see FIG. 3) at the desired rotation and further stabilizes the cleaning head 10 upon engagement with hardened smelt that would otherwise adversely rotate the cleaning head. The profile of the trailing edge 22 may also include inward curvature to assist with dislodging and/or removing any hardened smelt that may exist within or has otherwise been pushed to the center of the smelt spout.

Figure 4:
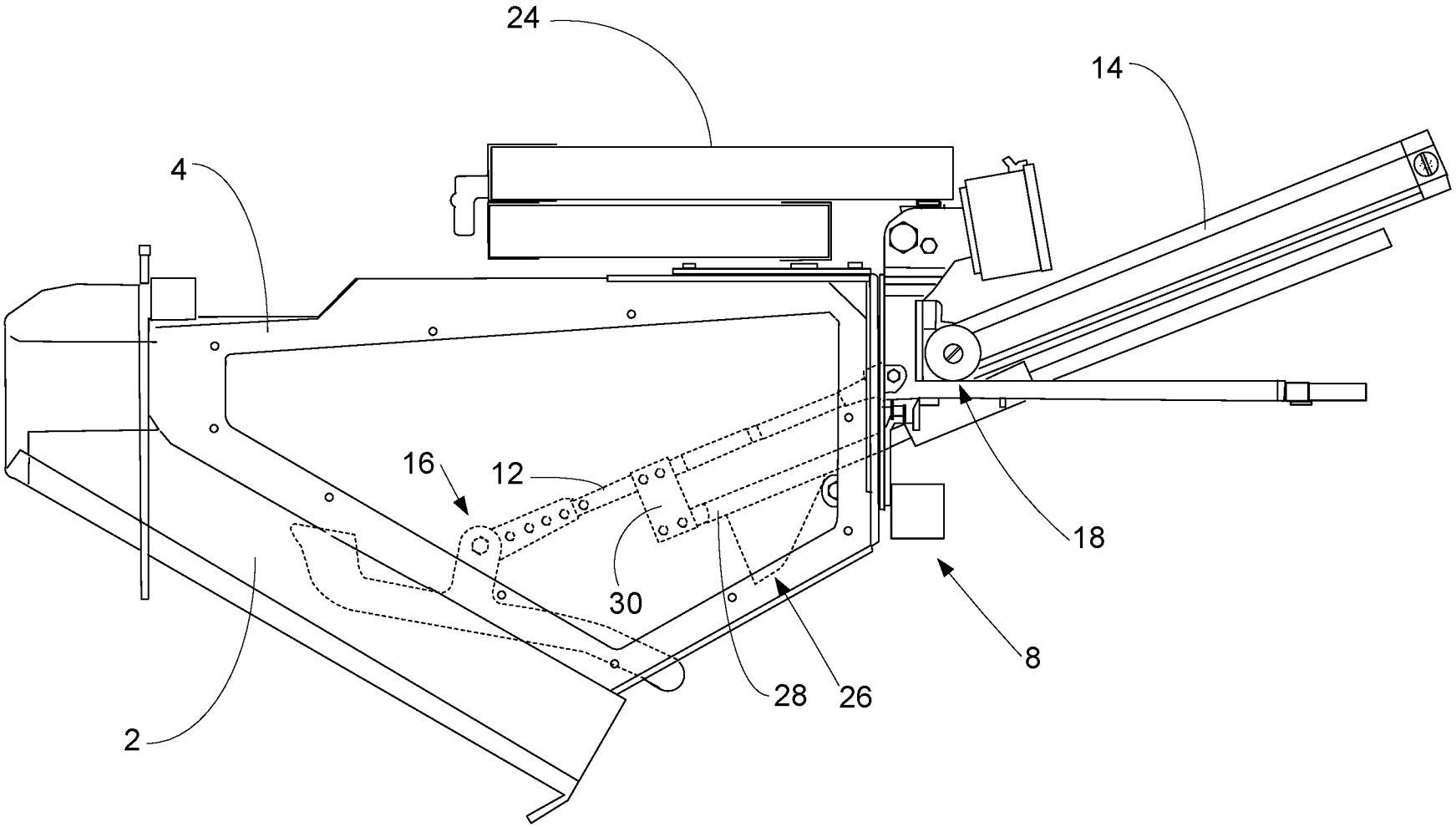
FIG. 4 diagrammatically illustrates a side view of the smelt spout and spout cleaning assembly of FIG. 1, with the cleaning/cutting head of the spout cleaning assembly engaging the smelt spout.

With continuing reference to FIGS. 1-3 and with further reference to FIG. 4, in a method of operation, the cleaning head 10 is extended between a first position and a second position. During this extension, the cleaning head 10 may rotate about the first pivot point 16, the first pivot point 16 being a connection between the cleaning head 10 and the drive rod 12 (see, e.g., FIG. 2). As best seen in FIG. 4, rotation may also occur about the second pivot point 18, the second pivot point being the pivot point 18 along the length the drive rod 12/drive 14 assembly. The second pivot point permits the assembly including the cleaning head 10 and the pivot arm 12 (and, optionally, portion of the drive 14) up to the second pivot point 18 to act as swing arm. Notably, as the drive rod 12 extends out of the drive 14, the torque applied about the pivot point 18 by the assembly including the cleaning head 10 and the extended portion of the drive rod 12 increases. This torque tends to rotate the cleaning head 10 downward, so that the cleaning head 10 is urged to move downward.

Operation may be done using various sequences. The operational sequence can include movement from a first position to a second position, a second position back to the first position, movement to and from intermediate position between the first position and the second position, and combinations and/or sequences of movements that includes one or more movements in series.

Figure 5:
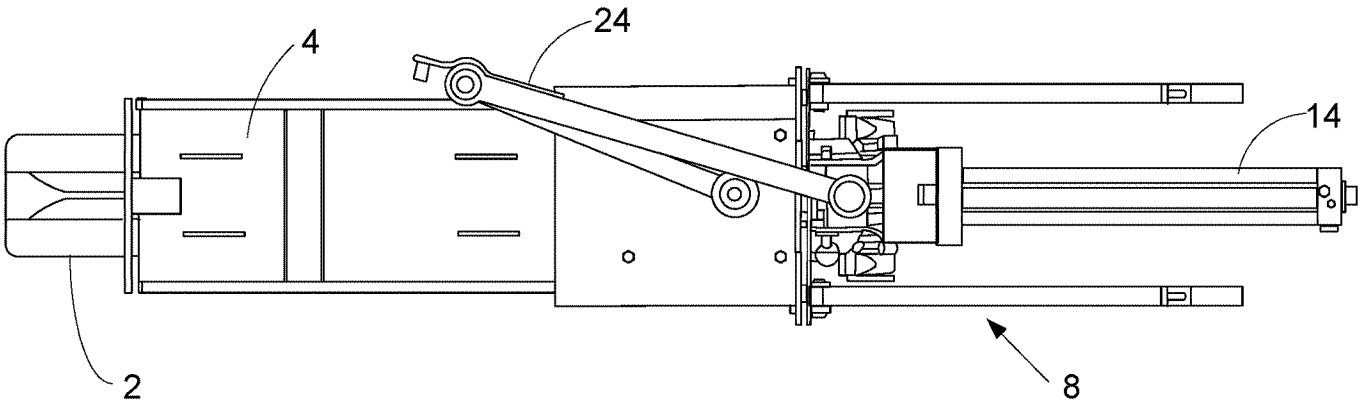
FIGS. 5 and 6 diagrammatically illustrate top and side views, respectively, of the spout cleaning assembly of FIGS. 1-4 in a resting position in which the cleaning/cutting head is lifted away from the smelt spout.
Figure 6:
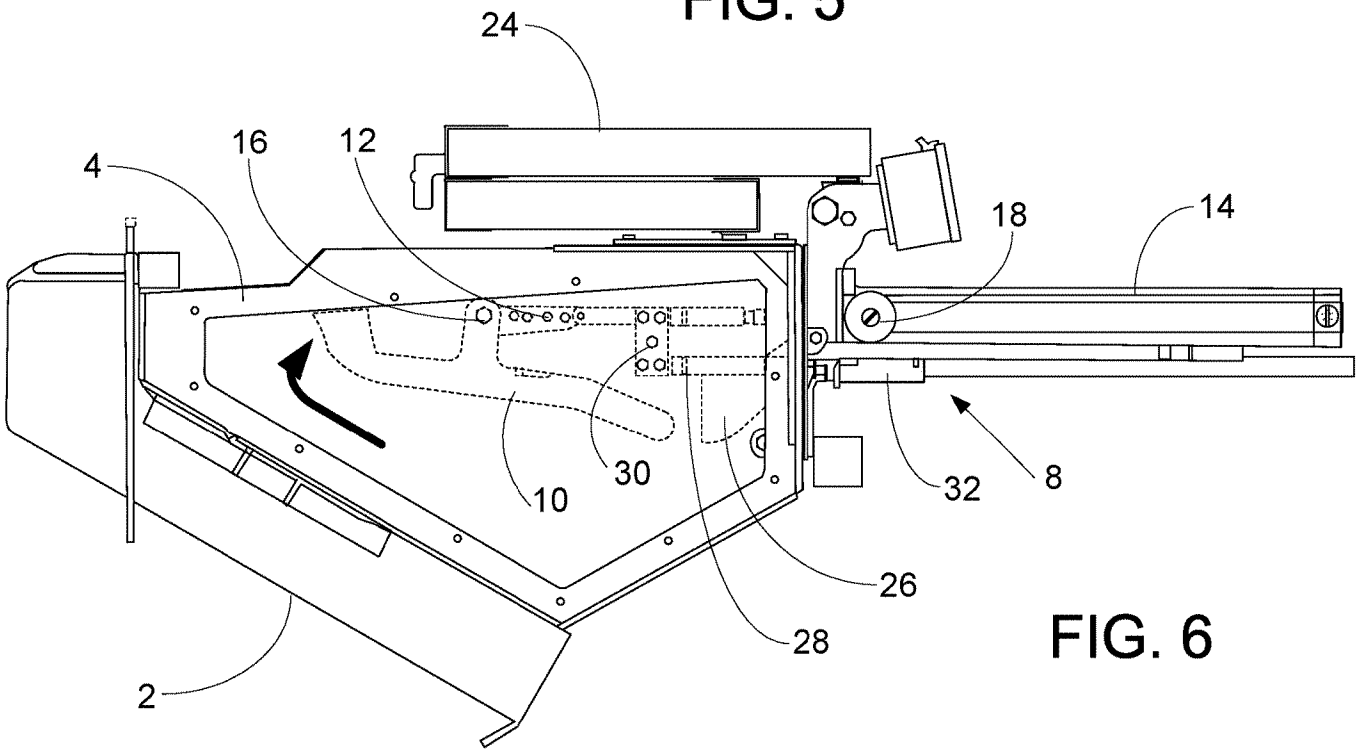
Figure 7:
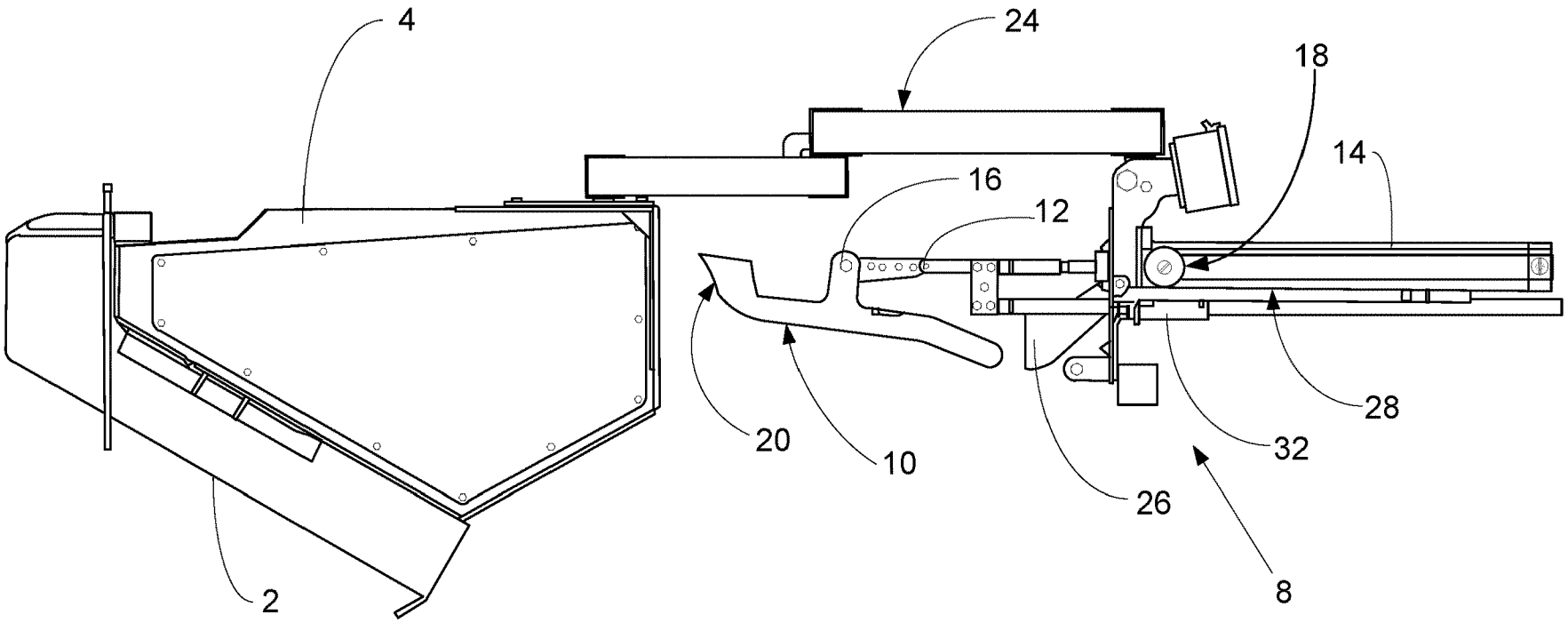
FIG. 7 diagrammatically illustrates a side view of the spout cleaning assembly of FIGS. 1-4 moved into a maintenance position providing access to the smelt spout for manual cleaning or other maintenance.

With reference to FIGS. 5, 6, and 7, operation may also include one or more maintenance modes and manual cleaning modes. FIGS. 5, 6, and 7 illustrate a transition from an operation position (shown in the top and side views of respective FIGS. 5 and 6) to a maintenance position (shown in the side view of FIG. 7). The cleaning assembly 8 is mounted to the spout 2 (or, more particularly in the illustrative embodiment, to the optional spout housing 4) by way of an articulated arm 24. As best seen in FIG. 6, prior to movement to the maintenance position the drive rod 12 is fully retracted into the pneumatic drive 14, thus reducing the torque of the assembly including the cleaning head 10 about the pivot point 18 to a minimum and causing counter-torque provided by (the portion of) the drive 14 on the other side of the pivot point 18 to lift the cleaning head 10 upward to its resting position (that is, to its resting position 11 indicated in FIG. 1). Notably, this lifts the cleaning head 10 away from the smelt spout 2. The resting position shown in FIG. 6 is the usual position when the smelt spout 2 is in use and cleaning is not being performed, as it leaves the smelt spout 2 clear so that smelt from the chemical reduction furnace (not shown) can pass through the spout opening 6 (see FIG. 3) and then flow down the smelt spout 2 to the smelt collection tank (not shown).

To transition from the resting operational position shown in FIGS. 5 and 6 to the maintenance position shown in FIG. 7, the cleaning assembly 8 is unlocked and/or unlatched from the spout housing or hood 4 and the cleaning assembly 8 is swung out and away from the spout/housing assembly 2, 4 using the articulated support arm 24. In this maintenance position shown in FIG. 7, maintenance be performed on the spout 2, spout opening 6, and/or spout housing 4 without the cleaning assembly 8 obstructing access to these components 2, 4, 6 for manual cleaning of the spout and/or other maintenance for the duration of maintenance activity. It will be appreciated that the articulated arm 24 could be replaced by another movable support mechanism such as a sliding support arm.

With reference back to FIG. 4, as previously noted, extension of the drive rod 12 increases the torque about the second pivot point 18 produced by the assembly including the cleaning head 10 and the extended portion of the drive rod 12, until this torque is sufficient to cause the cleaning head 10 to rotate downward into contact with the smelt spout 2. Optionally, as best seen in FIG. 4, a stopper 26 such as an illustrated downward projection, limits the downward rotation of the swing arm (including the cleaning head 10 and the extended portion of the drive rod 12). Alternatively, the stopper 26 may be omitted and the stopping force may be provided by contact of the cleaning head 10 onto the smelt spout 2. An additional feature best seen in FIG. 4 is that in the illustrative design an extended locking mechanism comprising a stabilizing rod 28 is arranged parallel with the drive rod 12, and the illustrative stopper 26 is attached to the stabilizing rod 28. The stabilizing rod 28 is attached to the drive rod 12 by a link 30 (labeled in FIGS. 4 and 6), and the stabilizing rod 28 extends or retracts together with the drive rod 12. The extended locking mechanism further comprises a collar 32 through which the stabilizing rod 28 passes. The collar 32 is secured to the pneumatic drive 14, so that the extended locking mechanism prevents rotation of the drive rod 12 about the axis of the drive rod.

In a contemplated variant, one or more cameras (not shown) are affixed to the spout cleaning assembly 8. The cameras are positioned in a manner that provides an unobstructed camera field-of-view of the spout 2 and cleaning activities thereby permitting remote monitoring.

In another contemplated variant, a retracting assembly assists in moving the cleaning head 10 to the resting position 11 indicated in FIG. 1 (e.g., as shown in FIG. 6) upon completion of a cleaning cycle. The retracting assembly is operative upon retraction of the drive rod/drive assembly 12, 14.

Figure 8:
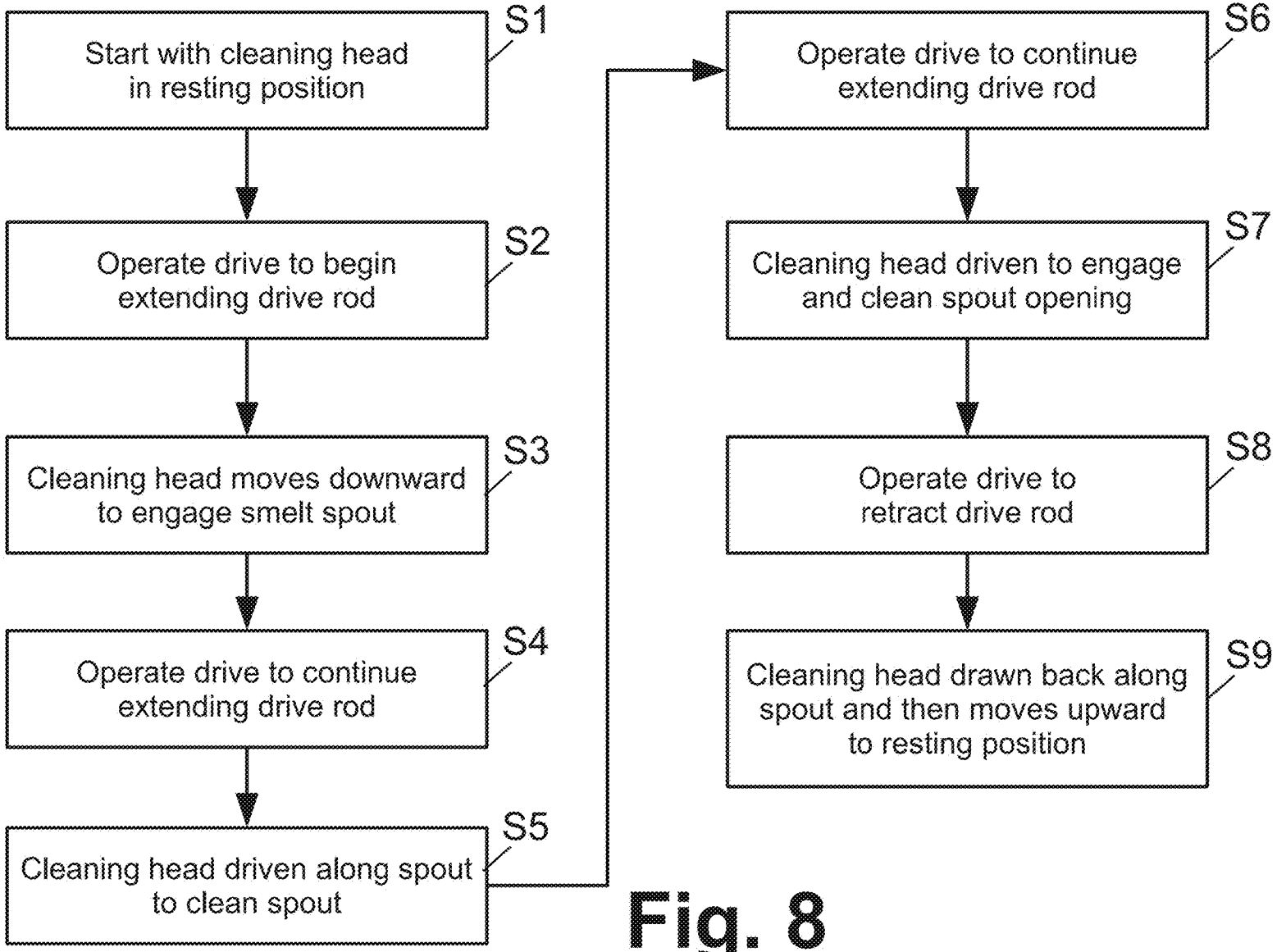
FIG. 8 diagrammatically illustrates a method for cleaning a smelt spout suitably performed using the spout cleaning assembly of FIGS. 1-4.

With reference to FIG. 8, a method for cleaning a smelt spout 2 suitably performed using the spout cleaning assembly of FIGS. 1-4 is described. In an operation S1, the cleaning head 10 is initially in its resting position 11 indicated in FIG. 1 and shown in FIG. 6. In an operation S1, the drive 14 is operated, e.g. pneumatically in the case of a pneumatic drive 14, or hydraulically in the case of a hydraulic drive, or electrically in the case of an electric motor-powered drive, or so forth, to begin extending the drive rod 12. In an operation S3, the cleaning head moves downward to engage the smelt spout 2. This is diagrammatically indicated in FIG. 1 as a first movement M1. For example, this movement M1 may occur in response to the rod extension operation S2 as the drive rod 12 extends thus increasing torque on the pivot 18 which rotates the assembly of the cleaning head 10 and extended portion of the drive rod 12 to move the head 10 downward. The operation S3 terminates when the downwardly moving cleaning head 10 engages the smelt spout 2, as diagrammatically shown in FIG. 4.

In an operation S4, the drive 14 is continued to be operated to continue to extend the drive rod 12; and, in response, in operation S5 the cleaning head 10 is driven along the smelt spout 2 to clean the spout 2. This is diagrammatically indicated in FIG. 1 as a second movement M2. For example, the operation S5 may remove hardened smelt from the smelt spout 2, e.g. by cutting the hardened smelt, abrading the hardened smelt, or so forth.

In an operation S6, the drive 14 is continued to be operated to continue to extend the drive rod 12; and, in response, in operation S7 the cleaning head 10 (and more particularly its leading edge 20) is driven to engage and clean the spout opening 6, as shown in FIG. 3. This is diagrammatically indicated in FIG. 1 as a third movement M3.

In an operation S8, the drive 14 is reversed to retract the drive rod 12. In response, in an operation S9 the cleaning head 10 is drawn back along the smelt spout to retrace the movements M3 and M2 and to move the cleaning head 10 upward back to the resting position 11, thus retracing the movement M1. For example, the latter upward motion of the cleaning head 10 retracing the movement M1 may occur in response to the rod retraction operation S8 as the drive rod 12 retracts thus reducing torque on the pivot 18 until the assembly of the cleaning head 10 and extended portion of the drive rod 12 rotates to move the head 10 upward back to its resting position 11.

It will be appreciated that the drawing back of the cleaning head 10 along the smelt spout 2 to retrace the movements M3 and M2 can contribute to the cleaning of the smelt spout 2. Additionally, it is contemplated to repeat the operations S4, S5, S6, S7, S8, S9 to produce two or more passes of back-and-forth movement of the cleaning head 10 over the spout 2 to improve the cleaning effectiveness.

Preferably, the method of FIG. 8 is performed under computer control. For example, an electronic control box with a microprocessor can be programmed to control the drive 14 to perform the method of FIG. 8. In one approach, the control box has a manual "start" button to enable an operator to manually initiate the cleaning. The control box may include a timer (e.g., the clock of the microprocessor) to ensure the various operations of the method of FIG. 8 are performed over desired time intervals. In another approach, the control box is programmed to perform the cleaning method of FIG. 8 at preset time intervals, which may be timed with control operations of the chemical reduction furnace to ensure the cleaning does not interfere with operation of the furnace. For example, in one contemplated preset, the method of FIG. 8 is run every 10 minutes with three cleaning cycles (i.e. three repetitions of the operations S4, S5, S6, S7, S8, S9 to produce three back-and-forth passes of the cleaning head 10 over the spout 2. This is merely a nonlimiting illustrative example.

While the above description constitutes the preferred embodiment of the present invention, it will be appreciated that the invention is susceptible to modification, variation and change without departing from the proper scope and fair meaning of the accompanying claims.

The invention claimed is:

1. An assembly for cleaning a smelt spout, the assembly comprising:

a cleaning head;

a drive rod connected with the cleaning head;

a drive connected to selectively extend or retract the drive rod;

a first pivot point at the connection of the cleaning head to the drive rod; and a second pivot point;

wherein the cleaning head, the drive rod, and the drive form a swing arm that is pivotable about the second pivot point.

2. The assembly of claim 1 wherein as the drive selectively extends the drive rod, torque about the second pivot point produced by the cleaning head and an extending portion of the drive rod rotates the cleaning head downward to engage a smelt spout.

3. The assembly of claim 1 wherein the cleaning head is bifurcated.

4. The assembly of claim 1 wherein the cleaning head includes a leading edge configured to engage and clean a spout opening from which smelt from a chemical reduction furnace flows to the spout.

5. The assembly of claim 4 wherein the leading edge of the cleaning head is bifurcated.

6. The assembly of claim 1 wherein the drive comprises a pneumatic drive.

7. The assembly of claim 1 wherein the cleaning head has a length and the length has a curved profile.

8. A smelt spout assembly comprising:

a smelt spout; and an assembly as set forth in claim 1 arranged to clean the smelt spout.

9. A smelt spout assembly comprising:

a smelt spout; and an assembly as set forth in claim 1 arranged by a connection with the smelt spout or with a housing of the smelt spout to clean the smelt spout.

10. A smelt spout assembly comprising:

a smelt spout; and an assembly as set forth in claim 1 arranged to clean the smelt spout;

wherein the assembly is mounted on an articulated arm by which the assembly can be swung out and away from the smelt spout.

11. A method of cleaning a smelt spout using the smelt spout assembly of claim 1, the method comprising:

extending the drive rod on which the cleaning head is pivotally attached by the first pivot point; and in response to the extending, pivoting the cleaning head about the second pivot point to lower the cleaning head onto the smelt spout and then driving the cleaning head along the spout to clean the spout.

12. The method of claim 11 wherein, in further response to the extending, driving the cleaning head at least partway into a spout opening to clean the spout opening.

13. The method of claim 11 further comprising:

retracting the drive arm; and in response to the retracting, drawing the cleaning head back along the spout and then pivoting the cleaning head about the second pivot point to raise the cleaning head away from the smelt spout and into a resting position.

14. An assembly for cleaning a smelt spout, the assembly comprising:

a drive rod;

a cleaning head pivotally attached to the drive rod;

a drive connected to selectively extend or retract the drive rod; and a second pivot about which the cleaning head rotates to selectively lower the cleaning head in response to the drive extending the drive rod and to selectively raise the cleaning head in response to the drive retracting the drive rod.

15. The assembly of claim 14 wherein the cleaning head is bifurcated.

16. The assembly of claim 15 wherein the cleaning head includes a leading edge configured to extend at least partway into a spout opening.

17. The assembly of claim 14 wherein the drive comprises a pneumatic drive.

18. The assembly of claim 14 wherein the second pivot is a pivot point of a swing arm that includes the drive, the drive rod, and the cleaning head.

19. The assembly of claim 18 wherein:

the drive is operative to lower the cleaning head by extending the drive rod to increase torque on the swing arm about the second pivot point produced by the cleaning head and the extended portion of the drive rod to lower the cleaning head; and the drive is operative to raise the cleaning head by retracting the drive rod to reduce said torque to raise the cleaning head.

20. An assembly for cleaning a smelt spout, the assembly comprising:

a drive rod;

a cleaning head pivotally attached to the drive rod;

a drive connected to selectively extend or retract the drive rod;

a second pivot about which the cleaning head rotates to selectively lower the cleaning head in response to the drive extending the drive rod and to selectively raise the cleaning head in response to the drive retracting the drive rod; and an extended locking mechanism including:

a stabilizing rod arranged parallel with the drive rod and attached to the drive rod by a link whereby the stabilizing rod extends or retracts together with the drive rod; and a collar through which the stabilizing rod passes, the collar secured to the drive.

21. A smelt spout assembly comprising:

a smelt spout; and an assembly as set forth in claim 14 arranged to clean the smelt spout.

* * * * *